United States Patent [19]

Hynes

[11] 4,364,550

[45] Dec. 21, 1982

[54] CORRUGATION VENTURI PAPER FEEDER

[75] Inventor: Frank R. Hynes, Rochester, N.Y.

[73] Assignee: Xerox Corporation, Stamford, Conn.

[21] Appl. No.: 193,557

[22] Filed: Oct. 3, 1980

[51] Int. Cl.[3] ..... B65H 3/14; B65H 3/06

[52] U.S. Cl. ..... 271/11; 271/97; 271/112; 271/120; 271/188

[58] Field of Search ..... 271/97, 98, 104, 105, 271/118, 119, 120, 112, 188, 11, 114

[56] References Cited

U.S. PATENT DOCUMENTS

| | | | |
|---|---|---|---|
| 2,843,377 | 7/1958 | Battersby | 271/188 |
| 3,158,367 | 11/1964 | Tarbuck | 271/11 X |
| 3,219,340 | 11/1965 | Hori et al. | 271/97 X |
| 3,220,605 | 11/1965 | Casey | 271/120 X |
| 3,547,431 | 12/1970 | Wagner | 271/97 X |
| 3,614,089 | 10/1971 | Van Auken et al. | 271/104 X |
| 3,624,807 | 11/1971 | Schwebel | 271/236 |
| 3,630,516 | 12/1971 | Hong | 271/120 X |
| 3,891,163 | 6/1975 | Wilkerson et al. | 244/42 CD |
| 4,043,549 | 8/1977 | Rinehart | 271/118 |
| 4,066,254 | 1/1978 | Stange et al. | 271/236 |
| 4,168,831 | 9/1979 | Rebel et al. | 271/177 |

FOREIGN PATENT DOCUMENTS

| | | | |
|---|---|---|---|
| 483855 | 6/1975 | Australia | 271/97 |

*Primary Examiner*—Bruce H. Stoner, Jr.

[57] ABSTRACT

An apparatus for feeding individual substrates from the top of a stack upon demand includes an air nozzle that directs air along the bottom surface of an airfoil located above the front end of the stack. The combined effect of air pressure from the nozzle and the shape of the airfoil serves to lift the leading edge of the top sheet in the stack above a restraining member. A paddle wheel drives the separated sheet away from the stack.

1 Claim, 3 Drawing Figures

CORRUGATION VENTURI PAPER FEEDER

BACKGROUND OF THE INVENTION

This invention relates generally to an electrophotographic printing machine, and more particularly concerns a substrate feeding system for feeding substrates from a stack along a predetermined path.

In modern high speed sheet processing machines such as printers, sorters, collators, reproduction machines, etc., multi-feeding of sheets can seriously impair operation of the machine. Numerous devices such as impact-/paddle feeders of the type disclosed in U.S. Pat. No. 3,630,516, have been employed to minimize the possibility of mis-feeds or multi-feeds.

The aforementioned impact feeders or "inertia feeders" have been employed in top sheet feed devices in an attempt to overcome intersheet friction and assure positive feeding of sheets by jarring or impacting the sheet to be fed and the adjacent sheets. However, in impacting sheets, there is a tendency for the impacting device to jam the sheet to be fed into tighter engagement with the remainder of the sheets in the stack, thereby obviating the benefits obtained in attempting to impact the sheet in the feed direction, off from the remainder of the sheets in the stack. As an improvement, the present top feeder uses combined air jet and air foil shape to lift the top sheet in a stack away from the remainder of the stack before applying an impact feeding mechanism to the stack.

SUMMARY OF THE INVENTION

Accordingly, in an aspect of the invention, a paper feeder comprises a support for supporting a stack of substrates, a restraining member located at the front of the stack for inhibiting forward movement of the substrates in the stack and corrugation feed means adapted to receive a substrate after it has been separated from the stack and forward it in a predetermined path. An air nozzle is positioned above the stack of sheets and applies air pressure to an airfoil member located adjacent the restraining member. Due to a venturi effect, the air pressure lifts the top sheet above the restraining member while a forward feed means propels the sheet past the restraining member and into the corrugating feed means.

BRIEF DESCRIPTION OF THE DRAWINGS

Other objects and advantages of the present invention will become apparent upon reading the following detailed description and upon reference to the drawings, in which.

While the present invention will be described hereinafter in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
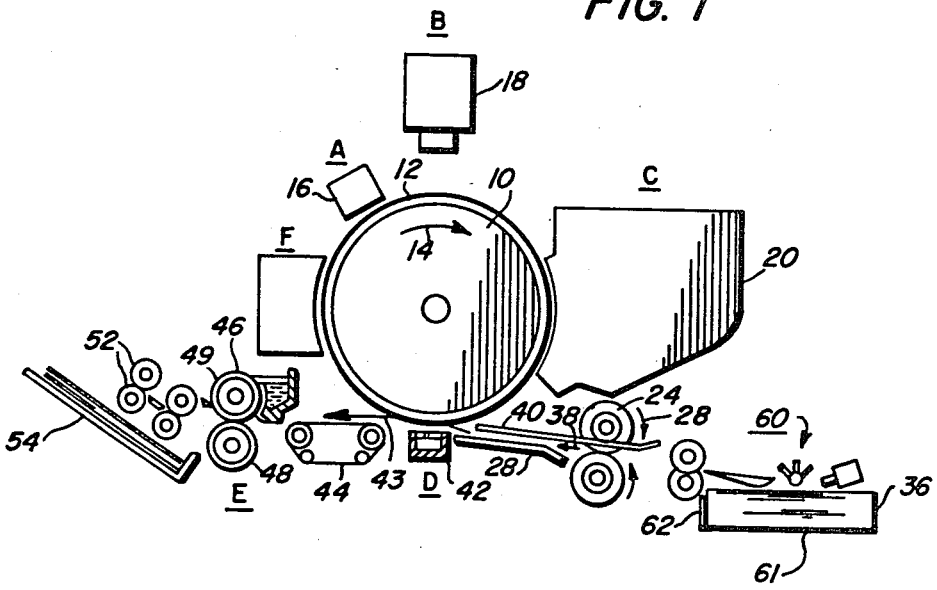
FIG. 1 is a schematic elevational view of an electrophotographic printing machine incorporating the features of the present invention.

For a general understanding of an electrophotographic printing machine in which the features of the present invention may be incorporated, reference is made to FIG. 1 which depicts schematically the various components thereof. Hereinafter, like reference numerals will be employed throughout to designate identical elements. Although the apparatus for forwarding sheets along a predetermined path is particularly well adapted for use in the electrophotographic printing machine of FIG. 1, it should become evident from the following discussion that it is equally well suited for use in a wide variety of devices and is not necessarily limited in its application to the particular embodiment shown herein. For example, the apparatus of the present invention will be described hereinafter with reference to feeding successive copy sheets, however, one skilled in the art, will appreciate that it may also be employed for feeding successive original documents.

Since the practice of electrophotographic printing is well known in the art, the various processing stations for producing a copy of an original document are represented in FIG. 1 schematically. Each processing station will be briefly described hereinafter.

As in all electrophotographic printing machines of the type illustrated, a drum 10 having a photoconductive surface 12 entrained about and secured to the exterior circumferential surface of a conductive substrate is rotated in the direction of arrow 14 through the various processing stations. By way of example, photoconductive surface 12 may be made from selenium of the type described in U.S. Pat. No. 2,970,906 issued to Bixby in 1961. A suitable conductive substrate is made from aluminum.

Initially, drum 10 rotates a portion of photoconductive surface 12 through charging station A. Charging station A employs a corona generating device, indicated generally by the reference numeral 16, to charge photoconductive surface 12 to a relatively high substantially uniform potential. A suitable corona generating device is described in U.S. Pat. No. 2,836,725 issued to Vyverberg in 1958.

Thereafter drum 10 rotates the charged portion of photoconductive surface 12 to expose station B. Exposure station B includes an exposure mechanism, indicated generally by the reference numeral 18, having a stationary, transparent platen, such as a glass plate or the like for supporting an original document thereon. Lamps illuminate the original document. Scanning of the original document is achieved by oscillating a mirror in a timed relationship with the movement of drum 10 or by translating the lamps and lens across the original document so as to create incremental light images which are projected through an opertured slit onto the charged portion of photoconductive surface 12. Irradiation of the charged portion of photoconductive surface 12 records an electrostatic latent image corresponding to the informational areas contained within the original document.

Drum 10 rotates the electrostatic latent image recorded on photoconductive surface 12 to development station C. Development station C includes a developer unit, indicated generally by the reference numeral 20, having a housing with a supply of developer mix contained therein. The developer mix comprises carrier granules with toner particles adhering triboelectrically thereto. Preferably, the carrier granules are formed from a magnetic material with the toner particles being made from a heat settable plastic. Developer unit 20 is preferably a magnetic brush development system. A system of this type moves the developer mix through a directional flux field to form a brush thereof. The electrostatic latent image recorded on photoconductive surface 12 is developed by bringing the brush of developer mix into contact therewith. In this manner, the toner particles are attracted electrostatically from the carrier granules to the latent image forming a toner powder image on photoconductive surface 12.

With continued reference to FIG. 1, a copy sheet is advanced by sheet feeding apparatus 60 to transfer station D. Sheet feeding apparatus 60 advances successive copy sheets to a pair of forwarding rollers 24. The upper forwarding roller 24 is driven by a motor (not shown) in the direction of arrow 28 and the lower forwarding roller rotates in the direction of the arrow associated therewith in FIG. 1 when the upper roller is in contact therewith. In operation, feed device 60 operates to advance the uppermost sheet from stack 36. At this time, the forwarding rollers are spaced from one another. This defines a gap through which the leading edge of the sheet moves. After the leading edge of the sheet is registered, the forwarding rollers move into contact with the sheet so as to advance the sheet in the direction of arrow 38. The sheet is advanced through a chute formed by guides 28 and 40 to transfer station D. The detailed structure of the forwarding rollers 24 is described in commonly assigned pending U.S. application Ser. No. 890,176, filed Mar. 27, 1978 in the name of Abraham Cherian, now abandoned. However, in general, the rollers move into and out of contact with the sheet depending upon whether they are waiting for a sheet to be advanced into the gap therebetween and registered or if the sheet is being advanced thereby. Thus, when the rollers are waiting for a sheet to be advanced thereto, they are spaced from one another defining a gap for receiving the sheets. Contrawise, when the rollers are advancing a sheet, they are moved into contact with the sheet so as to advance it.

Continuing now with the various processing stations, transfer station D includes a corona generating device 42 which applies a spray of ions to the back side of the copy sheet. This attracts the toner powder image from photoconductive surface 12 to the copy sheet.

After transfer of the toner powder image to the copy sheet, the sheet is advanced by endless belt conveyor 44, in the direction of arrow 43, to fusing station E.

Fusing station E includes a fuser assembly indicated generally by the reference numeral 46. Fuser assembly 46 includes a fuser roll 48 and a backup roll 49 defining a nip therebetween through which the copy sheet passes. After the fusing process is completed, the copy sheet is advanced by rollers 52, which may be of the same type as forwarding rollers 24, to catch tray 54.

Invariably, after the copy sheet is separated from photoconductive surface 12, some residual toner particles remain adhering thereto. These toner particles are removed from photoconductive surface 12 at cleaning station F. Cleaning station F includes a corona generating device (not shown) adapted to neutralize the remaining electrostatic charge on photoconductive surface 12 and that of the residual toner particles. The neutralized toner particles are then cleaned from photoconductive surface 12 by a rotatably mounted fibrous brush (not shown) in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine. Referring now to the specific subject matter of the present invention, FIG. 2 depicts the top feeder system in greater detail.

Figure 2:
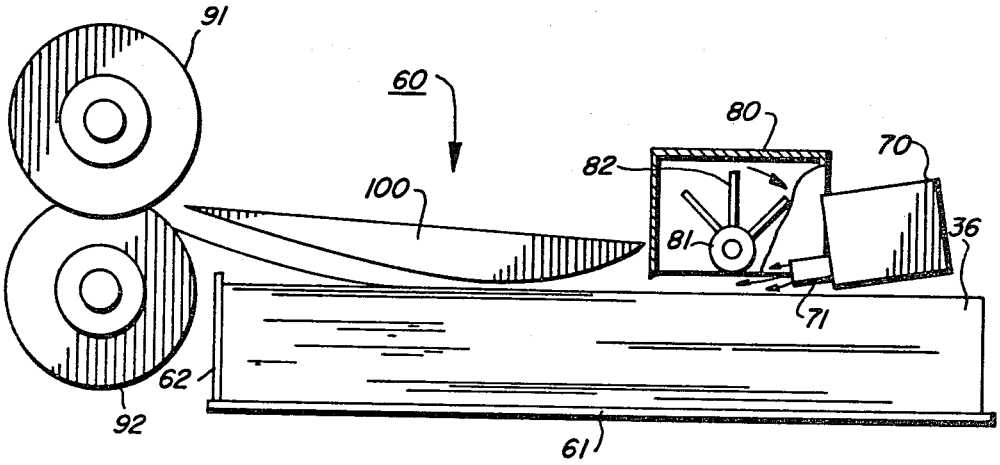
FIG. 2 is an enlarged side view of the substrate feeder system of the present invention shown in FIG. 1.

Referring now to FIG. 2, the detailed structure and operation of the present feeder system 60 will be described. Sheets 36 are shown stacked on platform 61 that has a sheet restraining wall 62 attached thereto. Substrates 36 are fed into decurling, corrugating take away rollers 91 and 92 by the combined action of air nozzle 70, segmented paddle wheel 81 and airfoil 100. Air nozzle 70 has an outlet 71 that extends over a major portion of the sheet or substrate stack. Positive air pressure applied from the outlet 71 strikes the stack at such an angle that the air is directed along the top surface of the stack and along the bottom surface of inverted airfoil 100. Since the air is directed along the bottom surface of the airfoil and due to the shape of the airfoil, i.e., a flat top and a curvilinear bottom surface, the leading edge of the top sheet in the stack, due to a venturi effect, is lifted up above restraining wall 62 and from the rest of the stack and caused to conform to the shape of the airfoil but without making positive contact along the bottom surface of the airfoil. Paddle wheel 81 is then rotated one revolution and through the use of paddles 82 propels the top sheet forward into corrugating forward movement rollers 91 and 92.

Segmented paddle wheel feed means 81 which is housed in enclosure 80 has blades or paddles 82 attached thereto. In the rest position as viewed in FIG. 2, the blades are not in contact with the sheet stack and are located in the 10, 12 and 2 o'clock positions, respectively. They are preferably 45° apart from each other and when in the rest position are located with respect to a circle at 315°, 0°, and 45°. Airfoil 100 can be grooved to maintain steady air flow. The advantage of a three paddle wheel as disclosed is that one complete revolution feeds only the top sheet and does not come in contact with the rest of the stack during the feeding of the top sheet. The paddle wheel could be controlled for one revolution per sheet by use of a one revolution clutch mechanism.

Figure 3:
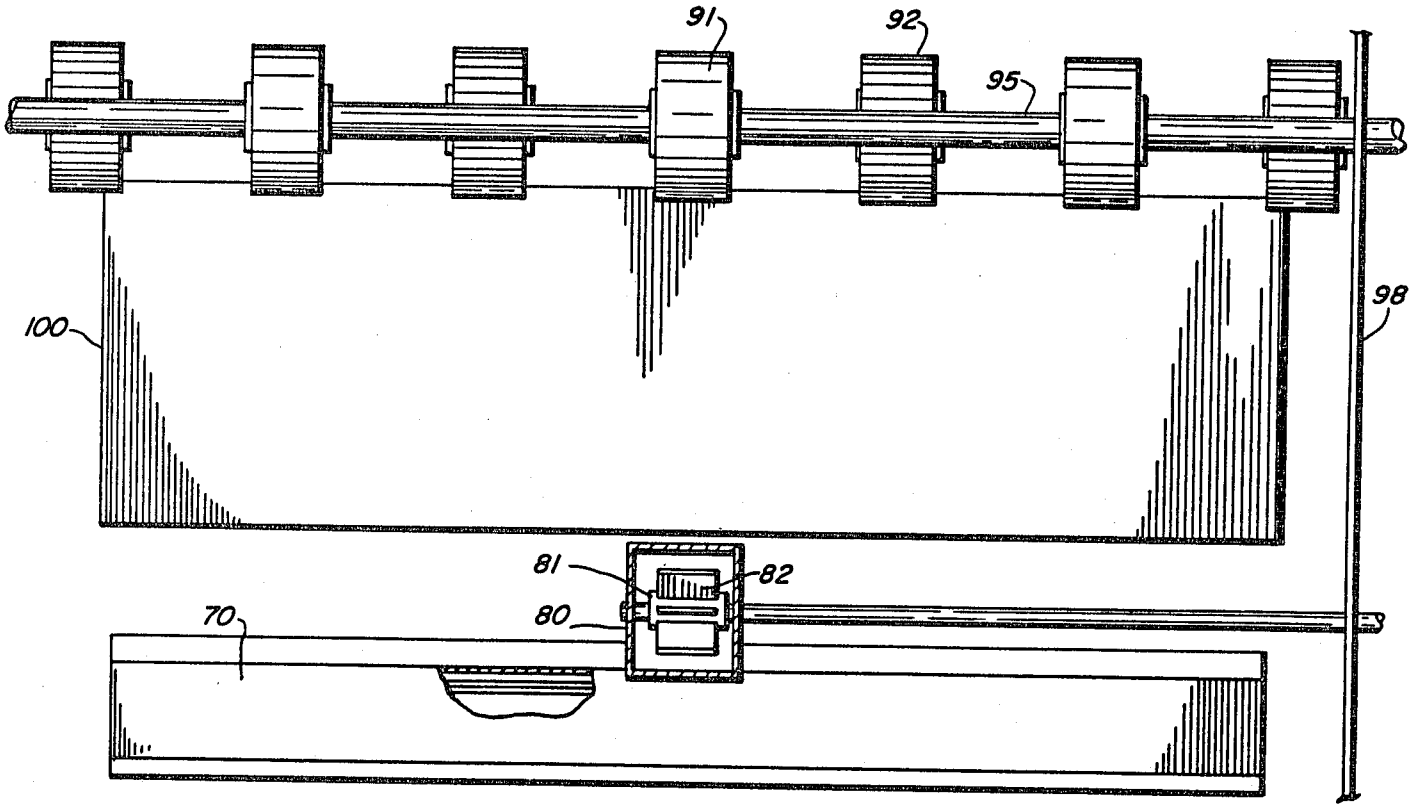
FIG. 3 is an enlarged partial plan view of the feeder in FIG. 2.

As shown in FIG. 3, plastic corrugating rollers 91 and 92 are positioned in front of the sheet stack and provide transport and decurling for a separated sheet toward photoreceptor surface 12. The rollers are offset or staggered with rollers 91 being supported above rollers 92 by support shaft 95 that is journaled for rotation in support member 98. The rollers remove any inherent or mechanically introduced curl in sheets being fed so that when further processing of the sheets take place sheet jams will not occur.

In conclusion, according to the present invention, a top paper feeder is disclosed that combines the use of an air nozzle, an airfoil and a segmented paddle wheel to separate sheets individually from a stack. Air from the nozzle is directed under the airfoil and thereby causes the leading edge of the top sheet in the stack to be lifted above a restraining wall where one revolution of the paddle wheel moves the top sheet to corrugating rollers that decurl the sheet.

It is therefore, evident that there has been provided in accordance with the present invention, a paper feeding system which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. A substrate feeder comprising in combination: support means for supporting a stack of substrates, said support means having front and rear ends;

restraining means connected to the front end of said support means such that movement of the substrates is inhibited;

air foil means having a flat top surface and a curvilinear bottom surface located adjacent said restraining means and above the front edge of the stack of substrates;

air nozzle means located adjacent the rear end of said support means for applying air pressure to said air foil means such that the leading edge of the top substrate in the stack is lifted above said restraining means and away from the stack and caused to conform to the shape of the air foil means without making positive contact along said curvilinear bottom surface of said air foil;

forwarding means for moving substrates away from the stack is located between said air foil means and said air nozzle means and includes a segmented paddle wheel having three blades positioned in reference to a circle at 315°, 0°, and 45° when in a non-feeding position, said paddle wheel is adapted to feed the top substrate from the stack of substrates every complete revolution and to not come in contact with the rest of the stack during the feeding of the top sheet; and decurling means located downstream from said restraining means and adapted through a series of corrugation rollers to remove any inherent or mechanically induced curl in the substrates that are forwarded.

* * * * *